US009290023B2

(12) United States Patent
Kudo

(10) Patent No.: US 9,290,023 B2
(45) Date of Patent: Mar. 22, 2016

(54) PRINTING APPARATUS, CONTROL METHOD, AND STORAGE MEDIUM

(71) Applicant: CANON KABUSHIKI KAISHA, Tokyo (JP)

(72) Inventor: Naotoshi Kudo, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/553,072

(22) Filed: Nov. 25, 2014

(65) Prior Publication Data

US 2015/0165792 A1 Jun. 18, 2015

(30) Foreign Application Priority Data

Dec. 16, 2013 (JP) ..... 2013-259504

(51) Int. Cl.

| | |
|---|---|
| ***B41J 29/393*** | (2006.01) |
| ***B41J 11/66*** | (2006.01) |
| ***B26D 1/18*** | (2006.01) |
| *B41J 11/70* | (2006.01) |
| *B26D 7/00* | (2006.01) |

(52) U.S. Cl.

CPC ..... *B41J 11/663* (2013.01); *B26D 1/185* (2013.01); *B26D 2007/005* (2013.01); *B41J 11/706* (2013.01)

(58) Field of Classification Search

CPC ..... B41J 29/393; B41J 29/38; B41J 29/02; B41J 11/42; B41J 2/04505

See application file for complete search history.

(56) References Cited

U.S. PATENT DOCUMENTS 8,430,586 B2 * 4/2013 Watanabe ..... 400/583

FOREIGN PATENT DOCUMENTS

| | | | |
|---|---|---|---|
| JP | 2002-254756 | A | 9/2002 |
| JP | 2003-231315 | A | 8/2003 |
| JP | 2003-260833 | A | 9/2003 |
| JP | 2005-103981 | A | 4/2005 |
| JP | 4193026 | A | 12/2008 |

OTHER PUBLICATIONS

European Office Action dated Jun. 26, 2015 issued in corresponding European Patent Application No. 14003767.2.

* cited by examiner

*Primary Examiner* — Lamson Nguyen

(74) *Attorney, Agent, or Firm* — Fitzpatrick, Cella, Harper & Scinto

(57) ABSTRACT

A printing apparatus according to the present invention includes a conveying unit conveying a printing medium, a printing unit, a cutting unit cutting the printing medium in a direction perpendicular to a conveying direction of the printing medium and a control unit. The control executes a test operation. The test operation includes printing a mark and cutting the printing medium while conveyance of the printing medium is stopped.

19 Claims, 11 Drawing Sheets

PRINTING APPARATUS, CONTROL METHOD, AND STORAGE MEDIUM

BACKGROUND OF THE INVENTION

1. Field of the Invention

The present invention relates to a printing apparatus, a control method, and a storage medium.

2. Description of the Related Art

When printing on a printing medium such as roll paper, it is necessary to cut the printing medium. There is known a printing apparatus including a cutter which cuts a printing medium. On the other hand, if the cutting position of a printing medium shifts, even a small shift may raise a problem. For example, such problems arise, for example, when high accuracy is required as in the case of drawings and when printing media on which images are printed by a plurality of printing apparatuses are bound into a book. More specifically, when the respective pages have different lengths, even if the leading ends of the pages are aligned, the trailing ends are misaligned. Printing all the pages of a booklet by using one printing apparatus can suppress the pages from having different lengths. However, this book differs in length from that formed by another printing apparatus. A cutting position shift is caused by factors such as an error in the conveyance amount of a printing medium and a mounting error of a cutter with respect to the printing apparatus.

As a method of eliminating cutting position shifts, Japanese Patent Laid-Open No. 2002-254756 has proposed a technique of correcting the conveyance amount of a printing medium in accordance with use conditions for a printing apparatus. Japanese Patent No. 4193026 and Japanese Patent Laid-Open No. 2003-231315 have proposed a technique of printing a pattern for cutting position verification on a printing medium, cutting the printing medium over the pattern, and setting a correction amount for a conveyance amount based on the cutting position and the pattern.

The technique disclosed in Japanese Patent Laid-Open No. 2002-254756 is designed to reduce an error in the conveyance amount of a printing medium but gives no consideration to a cutting position shift caused by a structural error such as a mounting error of a cutter with respect to a printing apparatus. The technique disclosed in Japanese Patent No. 4193026 and Japanese Patent Laid-Open No. 2003-231315 is designed to cut a printing medium after a pattern is printed and the printing medium is conveyed by a predetermined amount. An error can also occur in the conveyance amount of a printing medium. It is therefore not possible to determine whether a pattern cutting position shift is caused by either or both of a structural error and a conveyance error. Since a conveyance error varies, even correcting the conveyance amount by the correction amount obtained from a pattern cutting position sometimes results in a cutting position shift.

SUMMARY OF THE INVENTION

The present invention provides a technique of reducing the influence of an error in the conveyance amount of a printing medium when verifying a cutting position shift.

According to an aspect of the present invention, there is provided a printing apparatus comprising: a conveying unit configured to convey a printing medium; a printing unit configured to print an image on the printing medium; a cutting unit configured to cut the printing medium in a direction perpendicular to a conveying direction of the printing medium; and a control unit configured to control the conveying unit, the printing unit, and the cutting unit, wherein the control unit is configured to execute a test operation, and the test operation includes printing a mark by using the printing unit and cutting the printing medium by using the cutting unit while conveyance of the printing medium by the conveying unit is stopped.

Further features of the present invention will become apparent from the following description of exemplary embodiments (with reference to the attached drawings).

DESCRIPTION OF THE EMBODIMENTS

First Embodiment

Figure 1:
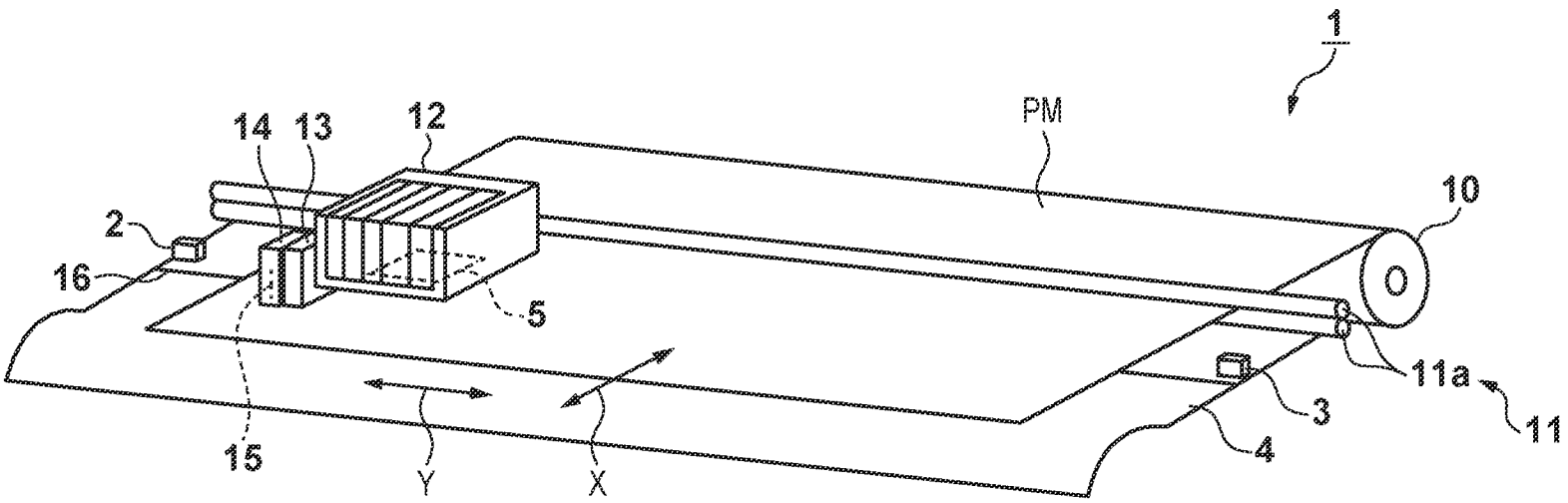
FIG. 1 is a schematic view of a printing apparatus according to an embodiment of the present invention.

FIG. 1 is a schematic view of a printing apparatus 1 according to an embodiment. This embodiment will exemplify a case in which the present invention is applied to a serial type inkjet printing apparatus. However, the present invention can be applied to other types of printing apparatuses.

Note that "printing" includes not only forming significant information such as characters and graphics but also forming images, figures, patterns, and the like on printing media in a broad sense, or processing printing media, regardless of whether the information formed is significant or insignificant or whether the information formed is visualized so that a human can visually perceive it. In addition, although in this embodiment, sheet-like paper is assumed as a "printing medium", cloth, plastic film, and the like may be used as printing media.

<Arrangement of Apparatus>

A printing apparatus 1 is an apparatus which includes a conveying unit 11, a printing unit 5, a detecting unit 13, and a cutting unit 14, and prints an image on a printing medium PM. In this embodiment, the printing medium PM is roll paper 10 wound in a roll form. However, the printing medium PM may be a cut sheet cut in a standard-size in advance. The conveying unit 11 draws the printing medium PM from the roll paper 10 by the length required to print an image. Note that the roll paper 10 may be provided with a driving mechanism which rotates the roll paper to assist drawing and taking up the printing medium PM.

The conveying unit 11 can convey the printing medium PM. In this embodiment, the conveying unit 11 includes a pair of conveying rollers 11*a*. The conveying unit 11 includes a driving mechanism (not shown) and rotationally drives one of the pair of conveying rollers 11*a* as a driving roller. The other of the pair of conveying rollers 11*a* is pressed with pressure against the driving roller to follow/rotate. The printing medium PM is conveyed on a platen 4 while being sandwiched between the pair of conveying rollers 11*a*. As the driving mechanism of the conveying rollers 11*a*, for example, a gear mechanism having a motor as a drive source can be used. A sensor (for example, an encoder) (not shown) detects the rotation amount of the conveying rollers 11*a* to control the conveyance amount of the printing medium PM.

In the following description, the terms "upstream side" and "downstream side" are used with reference to the conveying direction of the printing medium PM by the conveying unit 11. The conveying direction of the printing medium PM is indicated by an arrow X in FIG. 1 and sometimes called a sub-scanning direction. An arrow Y indicates a direction perpendicular to the conveying direction of the printing medium PM. This direction is sometimes called the main scanning direction. The roll paper 10 and the pair of conveying rollers 11*a* are arranged such that these axial directions are parallel to the main scanning direction Y.

The printing unit 5 is arranged downstream from the pair of conveying rollers 11*a*, and can print an image on the printing medium PM conveyed by the pair of conveying rollers 11*a*. In this embodiment, the printing unit 5 forms a printhead including a plurality of nozzles which discharge ink.

The printing unit 5 is mounted on a carriage 12. A tank which supplies ink to the printing unit 5 is mounted in the carriage 12. A driving mechanism (not shown) can reciprocally move the carriage 12 in the Y direction. As a driving mechanism for the carriage 12, for example, a belt transmission mechanism having a motor as a drive source can be used. A sensor (for example, an encoder) (not shown) detects the position of the carriage 12 to control the movement of the carriage 12.

The detecting unit 13 can detect the image printed on the printing medium PM, an edge of the printing medium PM, the thickness of the printing medium PM, or the like. The detecting unit 13 is mounted on the carriage 12 and moves in the Y direction, together with the carriage 12. The detection result obtained by the detecting unit 13 can be associated with a position on the printing medium PM by using the detection result of the position of the carriage 12 and the conveyance amount of the printing medium PM by the conveying unit 11.

The detecting unit 13 includes, for example, an optical sensor including a light-emitting element and a light-receiving element. The light-emitting element irradiates the platen 4 with light. The light-receiving element receives the reflected light. When detecting the leading end position of the printing medium PM by using the detecting unit 13, for example, the printing medium PM is conveyed to temporarily pass through the detecting unit 13, and then conveyed backward to the upstream side. When the leading end of the printing medium PM passes through the detecting unit 13, the value of light received by the light-receiving element varies due to the difference in reflectance between the platen 4 and the printing medium PM. It is possible to detect the position of the leading end of the printing medium PM from the detection result of the rotation amount of the conveying rollers 11*a*. Likewise, it is also possible to detect the position of the image printed on the printing medium PM from the detection result of the rotation amount of the conveying rollers 11*a* at a change point of the light-reception result obtained by the light-receiving element and the detection result of the position of the carriage 12.

The cutting unit 14 can cut the printing medium PM in the Y direction. The cutting unit 14 is mounted on the carriage 12, and moves in the Y direction, together with the carriage 12. In this embodiment, the cutting unit 14 includes a circular blade 15 which can be accommodated inside the unit. The cutting unit 14 incorporates an advancing/retracting mechanism for advancing/retracting the circular blade 15. When moving the carriage 12 to make the cutting unit 14 abut against a protruding portion 2, the advancing/retracting mechanism uses the pressing force to advance the circular blade 15 downward. When moving the carriage 12 to make the cutting unit 14 abut against a protruding portion 3, the advancing/retracting mechanism uses the pressing force to retract the circular blade 15 inside the cutting unit 14. The platen 4 is provided with a flat blade 16 extending in the Y direction.

When not cutting the printing medium PM, the circular blade 15 is retracted inside the cutting unit 14. This inhibits the circular blade 15 from cutting the printing medium PM. When cutting the printing medium PM, the circular blade 15 is advanced downward. The printing medium PM is held between the circular blade 15 and the flat blade 16. When moving the carriage 12, the circular blade 15 cuts the printing medium PM while rotating.

<Control Unit>

Figure 2:
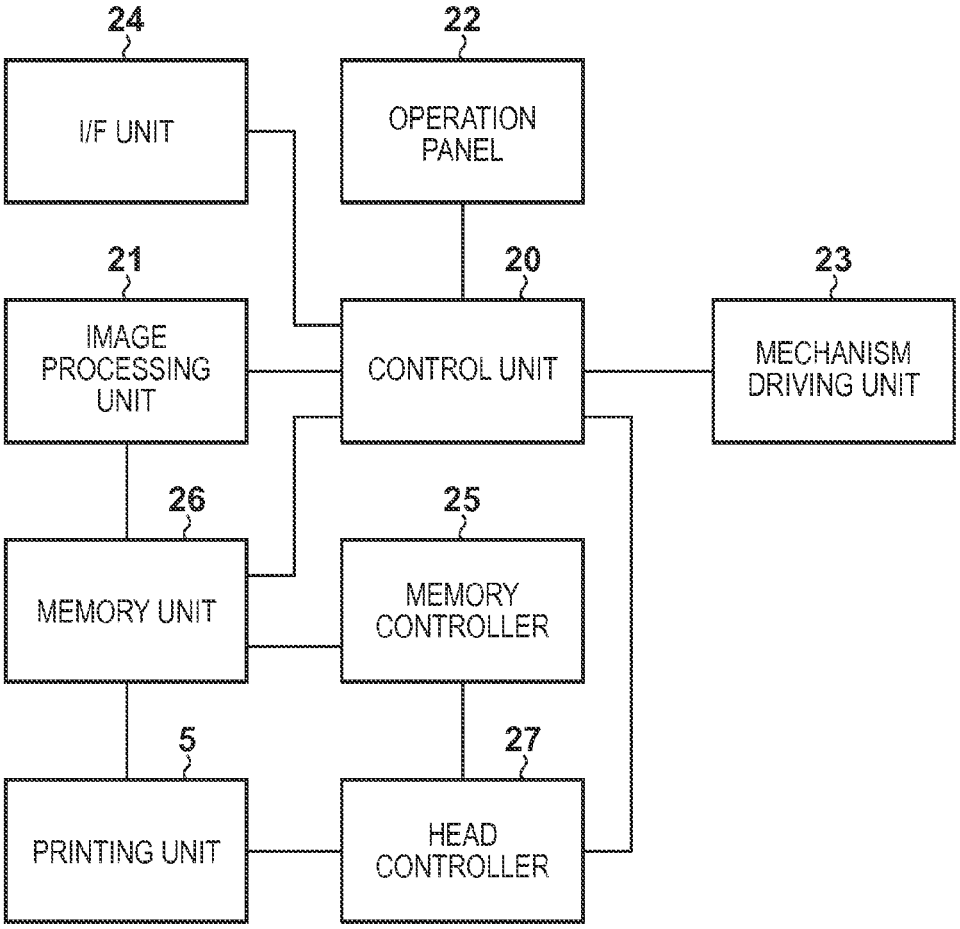
FIG. 2 is a block diagram showing the arrangement of the control unit of the printing apparatus in FIG. 1.

The arrangement of the control unit of the printing apparatus 1 will be described with reference to FIG. 2. A control unit 20 is, for example, a CPU, and controls the overall printing apparatus 1. A host computer (not shown) is communicatively connected to an I/F (interface) unit 24. The I/F unit 24 is, for example, a Centronics or USB interface. When the host computer sends a command and printing data to the printing apparatus 1, the printing apparatus 1 operates in accordance with the command to print an image on the printing medium PM. The printing apparatus 1 can also notify its state to the host computer by sending a command and data to the host computer. This makes it possible to send, for example, various types of notifications to the user.

An image processing unit 21 performs y correction, color processing, enlargement/reduction processing, binarization, and the like for the printing data (multilevel image data) sent from the I/F unit 24. The image processing unit 21 is constituted by, for example, a memory and a processor (for example, an ASIC, DSP, or RISC chip). The image processing unit 21 sometimes has an arrangement and a function so as to perform processing by using a driver or RIP (Raster Image Processor) on the host side, in order to achieve a reduction in cost.

The printing data bitmapped into a dot pattern at the last stage of processing in the image processing unit 21 is temporarily stored in a memory unit 26. The memory unit 26 is formed from, for example, a memory corresponding to one or more bands necessary for the carriage 12 to perform one scan in the main scanning direction to print. The memory unit 26 can also be used to store various types of information such as the information associated with a print image at the time of printing, the position information of the printing medium PM, and the information of a correction value for a cutting position.

A memory controller 25 writes/reads out printing data in/from the memory unit 26 under the control of the image processing unit 21, and generates an address signal and a write/readout timing signal for the memory unit 26.

The printing data read out from the memory unit 26 is output to a head controller 27 in synchronism with a readout signal from the head controller 27. The head controller 27 generates a timing signal for the discharging of ink and a heat pulse in the printing unit 5 based on a signal from a linear scale (not shown) under the control of the control unit 20. The printing unit 5 includes printheads corresponding to the respective color inks, and discharges ink upon heating the heater units under the control of the control unit 20 and the head controller 27.

A mechanism driving unit 23 includes the motors of driving mechanisms for the carriage 12 and the conveying unit 11, a recovery unit for recovering ink clogging, and various types of sensors. The control unit 20 acquires detection results from the sensors and controls the driving of the motors.

An operation panel 22 includes keys which are switches (not shown) and a display device which displays the state of the printing apparatus 1 and menus. The control unit 20 displays pictures, characters, and the like on a screen as the display device, monitors key operation, and accepts the input of various types information from the user.

<Cutting Position Shift Correction>

<Problems>

A structural error such as a mounting error of the cutting unit 14 or a conveyance error of the conveying unit 11 sometimes causes a shift in the cutting position of the printing medium PM by the cutting unit 14. It is sometimes impossible to improve the correction accuracy because of the presence of these error factors of a cutting position shift. This point will be described below. FIGS. 3A to 3D are views for explaining a problem in the correction of a cutting position shift.

Figure 3A:
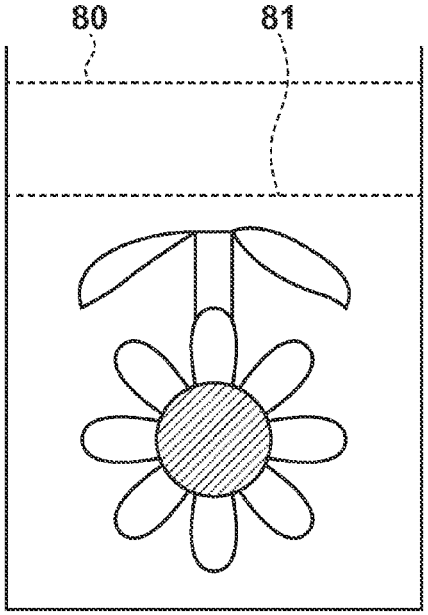
FIGS. 3A to 3D are views for explaining a problem in cutting position shift correction.

Referring to FIG. 3A, a broken line 80 indicates a position on a printing medium at which the medium should be cut, and a broken line 81 indicates a position at which the medium is actually cut. FIG. 3A shows an example of an extreme cutting position shift for easy understanding. The distance between the broken line 80 and the broken line 81 corresponds to the shift amount of the cutting position. Measuring this makes it possible to correct the cutting position shift.

Figures 3B, 3C, 3D:
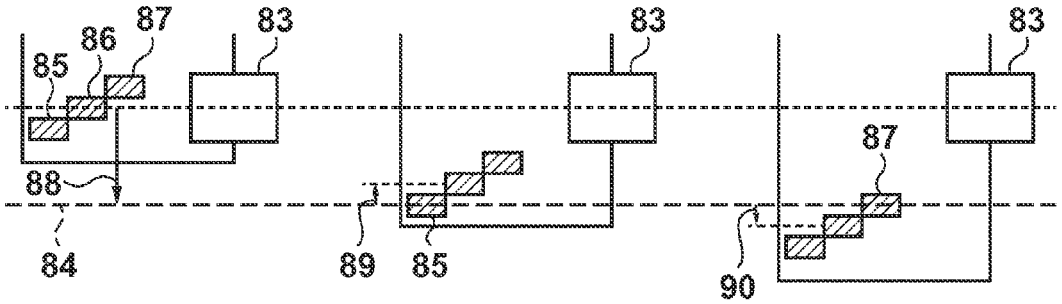

There is therefore available a method of obtaining the shift amount of a cutting position by printing cutting position adjustment patterns on a printing medium and cutting the medium over the patterns. FIGS. 3B to 3D show an example of this method. FIGS. 3B to 3D are views each showing a printing medium when viewed from above. A broken line 84 indicates an actual cutting position of the cutting unit.

First of all, as shown in FIG. 3B, a carriage 83 operates to print three rectangular patterns 85, 86, and 87. The printing medium is then conveyed by the conveyance amount indicated by an arrow 88 to locate the patterns 85, 86, and 87 on the broken line 84. The conveyance amount indicated by the arrow 88 is a control conveyance amount. If there is neither conveyance error nor structural error, the pattern 86 is cut in the middle.

In either of the cases shown in FIGS. 3C and 3D, the pattern 86 is not cut in the middle, and hence a cutting position shift has occurred. In the case shown in FIG. 3C, the cutting position has shifted to the downstream side by one pattern. In the case shown in FIG. 3D, the cutting position has shifted to the upstream side by one pattern. It is therefore possible to correct the cutting position shift by correcting the conveyance amount by this shift amount. However, the factor or factors of the cutting position shift are unknown. It is unknown whether the shift has been caused by either or both of a structural error such as an mounting error of the cutting unit 14 and a conveyance error of the conveying unit 11.

The variation amount of structural error such as a mounting error of the cutting unit 14 is relatively small. In contrast, the variation amount of conveyance error of the conveying unit 11 is relatively large.

Conveyance error factors include, for example, the following. Assume that when the motor is driven by 100 pulses while back tension is applied to roll paper, a printing medium is conveyed by 100 mm. When the printing medium is loosened to receive no back tension, the load is reduced. In this state, when the motor is driven by 100 pulses, the printing medium is sometimes conveyed by 150 mm. When the type of printing medium, the usage environment, or the like changes, the slip amount of the printing medium changes. This can cause such an error.

In addition, roll paper greatly varies in weight depending on a winding amount, width, and the like. Replacing roll paper of a small remaining amount by new roll paper will greatly change the weight. Conveying rollers sometimes become slow in rotation because of aged deterioration. In such a case, when the motor is driven by 100 pulses, the printing medium is sometimes conveyed by only 50 mm.

Assume, for example, a case in which the tolerance of a cutting position from the start of use to the end of use of one piece of roll paper falls within one pattern on each of the upstream and downstream sides. Assume that the case shown in FIG. 3C corresponds to an error of −1, and the case shown in FIG. 3D corresponds to an error of +1. According to the conveyance characteristics, if the error is −1 at the start of use of the roll paper, as in FIG. 3C, and the error is +1 at the end of use, as in FIG. 3D, conveyance within the tolerance range is implemented.

Consider a case in which the cutting position shift in FIG. 3C is corrected at the start of use of the roll paper while it is assumed that there is no structural error. In the case shown in FIG. 3C, since the cutting position has shifted to the downstream side by one pattern, it is possible to temporarily correct the cutting position shift by correcting the position by one pattern to the upstream side. If, however, the roll paper is used up in this state, the cutting position will shift to the downstream side by two patterns. As a result, the cutting position will deviate from the tolerance range of cutting positions.

In the method of conveying and cutting a printing medium after the printing of patterns in this manner, a conveyance error also occurs at the time of conveying the printing medium, and hence it is impossible to correct a cutting position shift caused by only a mounting error of the cutting unit. If the error indicated by an arrow 90 is included in the conveyance amount indicated by the arrow 88, the error is doubled as the conveyance amount is doubled by simple arithmetic. In practice, although a conveyance error is actually small, a high cutting position accuracy requirement cannot be sometimes met. Alternatively, in order to maintain high cutting position accuracy, pattern printing and cutting position correction must be frequently performed.

In addition, for example, as the printing length increases, the conveyance error increases, leading to an increase in cutting position shift. If, for example, printing is always performed by 1 m, it suffices to correct a cutting position shift in accordance with 1 m. If, however, printing is to be performed by both 1 m and 100 m, using a correction amount set assuming 1-m printing for 100-m printing sometimes causes a large cutting position shift. Calculating a correction amount for 100-m printing by printing patterns will waste the printing medium.

<Verification of Shift Independently of Conveyance Error>

This embodiment will propose a method of verifying a cutting position shift independently of a conveyance error. That is, the embodiment is configured to substantially measure only a structural error. A conventional method of correcting a conveyance error may be used to eliminate a conveyance error. Obviously, a conveyance error will shift the cutting position of the printing medium PM. However, the printed contents also shift in the same manner. Assume that when control is performed to print a straight line of 10 mm, a straight line of 15 mm is printed because of an conveyance error. In this case, the printing medium is cut at a cutting position shifted in the same manner. If, however, the conveyance error is corrected to print a straight line with a length of 10 mm, the printing medium is cut at a correct cutting position.

In this embodiment, a cutting position shift is measured by a scheme which excludes a conveyance error as much as possible, and is corrected, assuming that a conveyance error is corrected as a conveyance error. This makes it possible to properly correct a cutting position if there is no conveyance error.

A method of measuring a cutting position shift in this embodiment will be briefly described with reference to FIGS. 4A and 4B. The control unit 20 can execute the following test operation.

First of all, the conveying unit 11 conveys the printing medium PM to a position where an image can be printed by a specific nozzle of the printing unit 5 and the printing medium PM can be cut by the cutting unit 14. It suffices if the printing medium PM is located approximately on a side of the carriage 12.

Figure 4A:
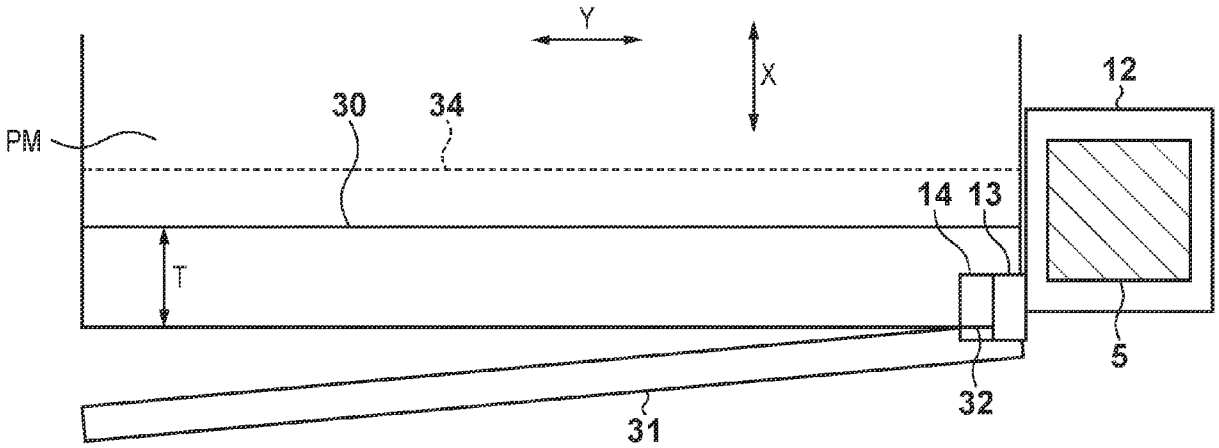
FIGS. 4A and 4B are views for explaining a method of measuring a cutting position shift.

As shown in FIG. 4A, while the conveying unit 11 stops conveying the printing medium PM, the printing unit 5 prints a mark 30 and the cutting unit 14 cuts the printing medium PM. In this case, the mark 30 is a straight line extending in the Y direction. The mark 30 is printed by discharging ink from a specific nozzle while moving the carriage 12 in the Y direction. The printing medium PM is cut by moving the carriage 12 in the Y direction while advancing the circular blade 15 of the cutting unit 14. A cut piece 31 is unnecessary.

It is possible to simultaneously or sequentially perform printing of the mark 30 and cutting of the printing medium PM. When simultaneously performing these operations, for example, printing of the mark 30 and cutting of printing medium PM are performed during one scan of the carriage 12. When sequentially performing these operations, for example, the mark 30 is printed first during one scan of the carriage 12 (for example, during forward movement), and the printing medium PM is then cut during another scan (for example, during backward movement).

In order to allow the user to easily measure a distance T, the printing medium PM is conveyed and is cut at a cutting position 34 by the cutting unit 14. With this operation, a cut piece is obtained, as shown in FIG. 4B. User auxiliary information may be printed on the printing medium PM before this cutting operation. User auxiliary information can include information indicating a position where the user should measure a length and information indicating a designed value (T2=30 mm) of the length to be measured. In the case shown in FIG. 4B, user auxiliary information 33 is shown as an example. In this case, a designed value (30 mm) is printed together with an arrow indicating a width to be measured. User auxiliary information can be printed before cutting and printing of a mark in FIG. 4A or simultaneously with printing of the mark.

As has been described above, the printing medium PM has not been conveyed between printing of the mark 30 and cutting of the printing medium PM. Therefore, information associated with the position of a cut end 32 of the printing medium PM and the position of the mark 30 is information representing a structural error. More specifically, the difference between the distance T from the cut end 32 of the cut piece to the mark 30 and the designed distance from the nozzle used to print the mark 30 to the cutting position of the cutting unit 14 represents a structural error. In this manner, when verifying a cutting position, it is possible to reduce the influence of an error in the conveyance amount of a printing medium. This embodiment, in particular, can eliminate the influence of a conveyance error.

A method of measuring a cutting position shift and a method of correcting a cutting position shift according to this embodiment will be described in more detail by exemplarily showing designed dimensions of the printing apparatus 1 and the like with reference to FIGS. 5A to 5D.

Figures 5A, 5B, 5C, 5D:
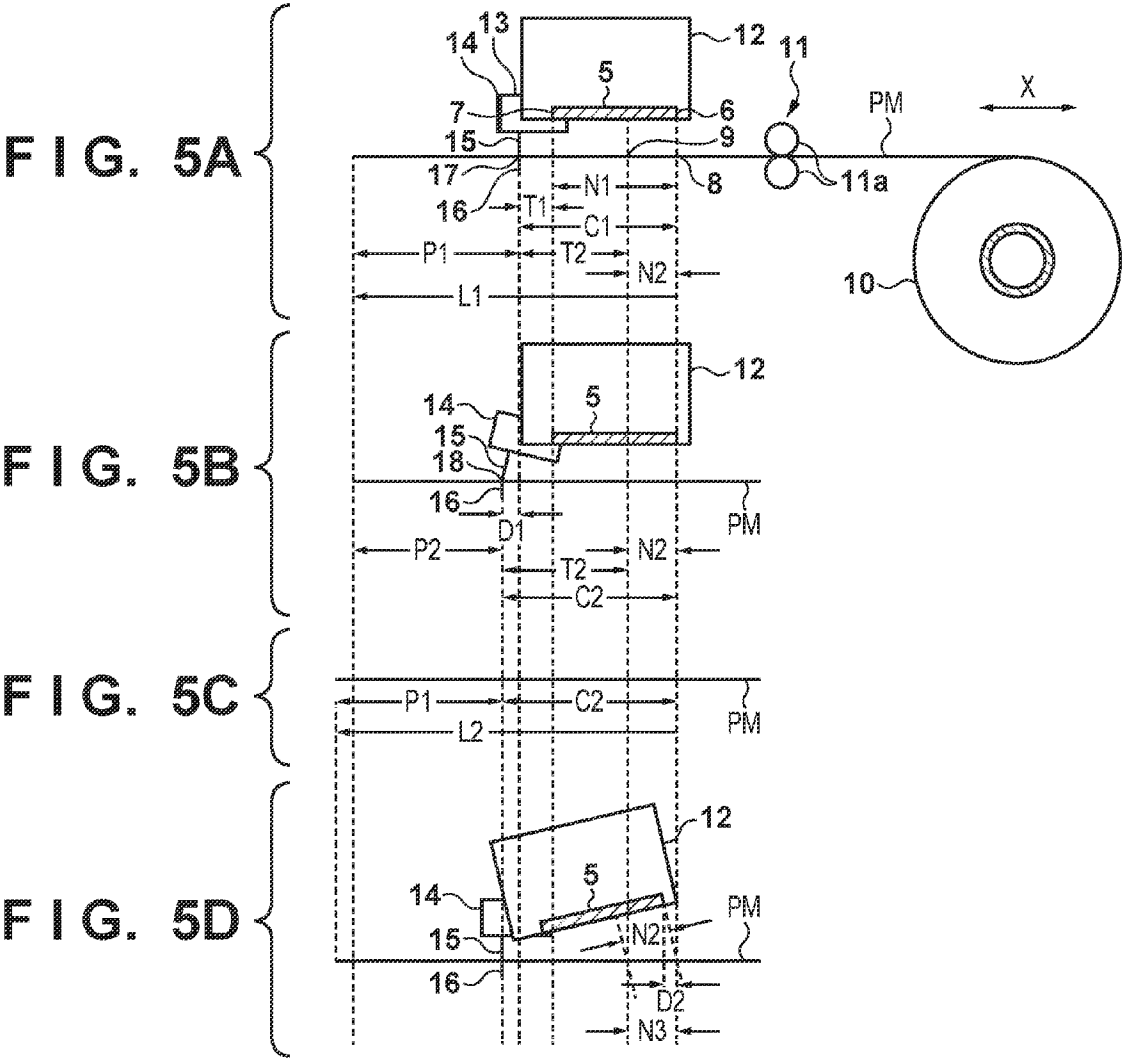
FIGS. 5A to 5D are views for explaining a dimensional relationship.

FIG. 5A shows a designed theoretical state of the cutting unit 14 without any structural error. This shows a state in which if there is no conveyance error, no cutting position shift occurs. Referring to FIGS. 5A to 5D, in the following description, a coordinate origin 8 is defined as a reference position (0 position), and the upstream and downstream sides with respect to the reference position are respectively defined as "minus" and "plus".

As described above, the printing unit 5 includes a plurality of nozzles which discharge ink, which are arrayed in the Y direction. Assume that the landing position of ink discharged from an uppermost stream nozzle 6 is the coordinate origin 8. The conveyance position of the printing medium PM is controlled based on a conveyance amount from the coordinate origin 8. In other words, the value of a sensor which detects the rotation amount of the conveying rollers 11*a* is initialized to 0 at a position where the leading end of the printing medium PM is located immediately below the uppermost stream nozzle 6.

Let N1 be a distance (nozzle width) from the uppermost stream nozzle 6 to a lowermost stream nozzle 7 in the Y direction. Assume that the width N1 of the nozzle array is, for example, 25 mm (≈1 inch). When the printing medium PM is conveyed by 25 mm in the Y direction while the leading end of the printing medium PM is located at the coordinate origin 8, the leading end of the printing medium PM is located immediately below the nozzle 7.

Note that in the following description, to facilitate understanding the contents, detailed conditions will be described as simple as possible. Various numerical values are examples, and the position at which the coordinate origin 8 should be set is not limited to that immediately below the nozzle 6, and may be another position.

The nozzle array of the printing unit 5 includes 1,280 nozzles. A distance T1 from the lowermost stream nozzle 7 to a cutting position 17 of the cutting unit 14 is 10 mm. A distance C1 from the origin 8 to the cutting position 17 is given by C1=T1+N1, which is 35 mm. In other words, a set value of 35 mm is set as the designed distance C1 from the origin 8 to the cutting position 17.

Assume that a nozzle to be used to print the mark 30 is that set at a predetermined position so as to print the mark at a mark position 9 located 30 mm upstream from the cutting position 17. A distance T2 indicates the distance from the cutting position 17 to the mark position 9, which is 30 mm. The distance T in FIGS. 4A and 4B is given by T=T2, when there is no cutting position shift. A distance N2 is the distance from the origin 8 to the mark position 9, which is 5 mm. Assume that the uppermost stream nozzle 6 is the first nozzle, and the lowermost stream nozzle 7 is the 1280th nozzle. The width N1 of the nozzle array (25 mm) corresponds to 1,280 nozzles, and hence the width per nozzle is about 0.0196 mm. The nozzle to be used to print a mark at the mark position 9 is the 257th nozzle (N2=257*0.0196=5.03, which is about 5 mm). In this embodiment, to facilitate understanding, the minimum resolution is 1 mm in the following description.

Note that when also giving consideration to an error in the arrangement of nozzles, the distance N2 may be an actual measurement value instead of a designed value. In addition, the nozzle to be used to print the mark 30 may be the uppermost stream nozzle 6 located at the position of the origin 8 or the lowermost stream nozzle 7. A plurality of nozzles may be used to print the mark 30. For example, the 256th to 258th nozzles including nozzles before and after the 257th nozzle may be used to print the mark 30. In this case, although the width (thickness) of the straight line as the mark 30 increases, the middle of the width may be set as the position of the mark 30. In addition, the number of marks 30 need not be one, but a plurality of marks may be used. For example, two straight lines may be printed as marks by discharging ink from the uppermost stream nozzle 6 and the lowermost stream nozzle 7. It is possible to use, as a structural error, the average value of the differences between the distances between the respective straight lines and the cut end 32 and the designed distances from the nozzles used to print the marks and the cutting position of the cutting unit 14.

Referring to FIG. 5A, a distance P1 is an example of a printing length. To cut the printing medium PM by the printing length P1, the printing medium PM is conveyed by a distance L1 from the position where the leading end of the printing medium PM is located at the origin 8, that is, the position immediately below the uppermost stream nozzle 6. L1=P1+C1. That is, conveying the printing medium PM by the distance L1 obtained by adding distance C1 to the printing length P1 will match the expected cutting position of the printing medium PM with the cutting position 17.

FIG. 5B shows an example in which a cutting position shift is caused by a structural error and, more specifically, an example in which a cutting position shift is caused by a mounting error of the cutting unit 14. The cutting position of the cutting unit 14 is located at a position 18 shifted from the designed cutting position 17 (FIG. 5A) by an error D1 to the downstream side. Assume that as in the case shown in FIG. 5A, when the printing medium PM is conveyed from the origin 8 by a conveyance amount L1 and cut, a printing length becomes P2. That is, the printing length becomes smaller than the printing length P1 by the error D1.

Figure 4B:
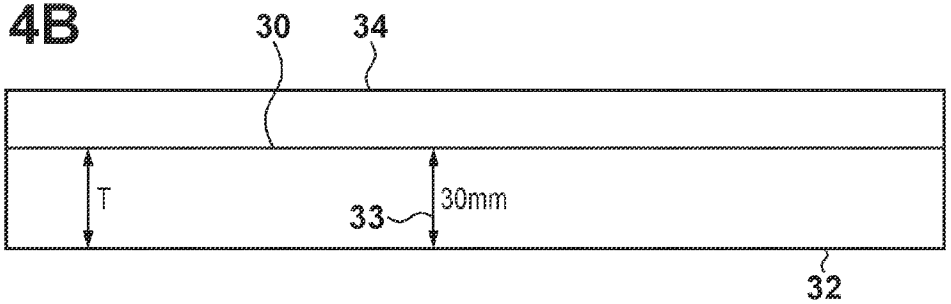

In the example shown in FIG. 5B, the distance T in FIGS. 4A and 4B corresponds to a distance T3. The distance T should be equal to the distance T2, but becomes T3 because of a structural error.

The error D1 is obtained by $$D1=T3-T2$$

Using this value as a correction value can correct a cutting position shift. A cutting position C2 after correction is the position obtained by adding D1 to a logical cutting position C1, and hence holds the following equation:

$$C2=C1+D1=C1+T3-T2$$

In consideration of computation for control, when using the previously obtained correction value, a cutting position C2' used at this time and a correction value D1' at the time may be defined as follows:

$$C2=C2'+D1=C1+D1'+D1$$

That is, the above equation holds because the cutting position C2' is used instead of the cutting position C1. Since an operation is performed at C2' without any correction value when no correction value has been obtained, C2'=C1+D1' holds.

FIG. 5C shows an example in which the conveyance amount of the printing medium PM is corrected in the example shown in FIG. 5B, and the printing medium PM is cut at the proper cutting position. As described with reference to FIG. 5B, the corrected value of the cutting position C2 could be obtained. For this reason, it is possible to cut the printing medium PM by the correct printing length P1 by conveying the printing medium PM by L2 from the position where the leading end of the printing medium PM is located immediately below the uppermost stream nozzle 6, that is, the origin 8. That is, it is possible to convey the printing medium PM to the correct cutting position by conveying the printing medium PM by the conveyance amount obtained by adding the corrected cutting position C2 to the printing length P1. L2=P1+C2. In addition, since L2=P1+C1+D1, the printing medium PM is conveyed by an extra amount corresponding to D1 as compared with the case shown in FIG. 5A. Conveying the printing medium PM by an extra amount corresponding to the error makes it possible to cut the printing medium PM by the correct printing length upon correcting the cutting position shift.

FIG. 5D shows a case in which the landing position of ink from the printing unit 5 has shifted. This shows an example of a structural error. When the printing unit 5 tilts to cause ink to land upstream, the cutting position shifts with respect to a printed image even without any mounting error of the cutting unit 14. The same applies to a case in which the mounting position of the printing unit 5 shifts to the right side in FIG. 5D and the landing position shifts to the upstream side.

In this case, when the printing unit 5 tilts as shown in FIG. 5D, the width of ink landing on the printing medium PM becomes smaller than the width N1 of the nozzle array, resulting in an error. For this reason, the width may be calculated from the landing position of ink from the uppermost stream nozzle 6 and that from the lowermost stream nozzle 7 to calculate the position of each nozzle. If, however, this error is small enough to be neglected, this operation need not be performed. This embodiment will be described on the assumption that this error is small enough to be neglected.

Letting D1 be a landing position shift, the correct printing length P1 can be obtained by conveying the printing medium PM by L2 and cutting it as in the cases described with reference to FIGS. 5B and 5C. In this case, when giving consideration to the tilt, N2 also differs. When the resultant value is represented by N3, it is only required to add an error D2 to the error D1 described above.

That is, the following equation holds:

$$D1=T3-T2+N3-N2$$

In this case, for the calculation of N3, in the examples shown in FIGS. 4A and 4B, in addition to the mark 30, a straight line mark may be printed in advance by using the uppermost stream nozzle 6, and the distance between the mark and the cut end 32 may be measured and used. In addition, if a specific nozzle which prints the mark 30 is the uppermost stream nozzle 6, N2=0 and N3=0 to allow the use of the same equation as that described above. In addition, a difference may be measured in advance to store the length. For example, the positions of the uppermost stream nozzle 6 and the lowermost stream nozzle 7 may be measured in advance, and the discharging position of ink from each nozzle may be calculated. Although the case in which a cutting position has shifted to the downstream side has been exemplified, even a cutting position shifted to the upstream side can also be corrected by the same method by only changing the sign of the value of D1 to negative.

Processing Example

An example of the processing performed by the control unit 20 associated with the above test operation and correction value setting concerning a cutting position shift will be described with reference to FIG. 6. The following will exemplify a case in which a test operation and correction value setting are executed in response to an instruction from the user.

Upon detection in step S1 that a key indicating the start of execution on the operation panel 22 is pressed, cutting position correction processing is started. Note that the reception of an instruction from the user may be started via an external terminal such as a PC or portable terminal other than the operation panel 22 upon execution of a maintenance mode. Alternatively, this operation may be started by another scheme, for example, when receiving data as a special job.

In step S2, the conveying unit 11 conveys the printing medium PM to a predetermined position where it is possible to print the mark 30 and cut the medium. In a normal printing operation, image printing corresponding to one paper sheet is performed by repeatedly performing the printing operation of discharging ink to the printing medium PM while moving the carriage 12 and conveyance of the printing medium PM by a predetermined amount. Upon completion of the image printing, the printing medium is conveyed by a predetermined amount and cut. In a test operation, unlike such a normal printing operation, the conveyance of the printing medium PM is stopped in step S3, and the printing medium PM is not conveyed until the processing in step S4 is complete.

In step S4, the printing medium PM is cut by the cutting unit 14, and the mark 30 is printed on the printing medium PM. As has been described with reference to FIG. 5A, the mark 30 is printed by the 257th nozzle at a position 30 mm apart from the cutting position 17 of the cutting unit 14. Since the printing medium PM is not conveyed, the density of the mark may be increased by scanning the carriage 12 a plurality of times instead of just once.

In a normal printing operation, since the printing medium PM is conveyed again and cut upon completion of image printing, it is difficult to simultaneously perform printing and cutting. In a test operation, however, no problem arises even if printing and cutting are simultaneous executed. Simultaneously executing cutting and printing of the mark 30 can improve the throughput.

Although this embodiment exemplifies the arrangement in which the cutting unit 14 is mounted on the carriage 12, it is possible to use an arrangement in which the cutting unit 14 is not mounted on the carriage 12. That is, the cutting unit 14 can be arranged in any manner as long as it is possible to print the mark 30 and cut the printing medium PM without conveying the printing medium PM.

In step S5, the stop of the conveyance of the printing medium PM is canceled to enable conveyance. In step S6, user auxiliary information is printed on the printing medium PM. The user auxiliary information is the same as that described with reference to FIG. 4B. Thereafter, the printing medium PM is conveyed and cut at the position exemplified by the cutting position 34 in FIG. 4A.

In step S7, the input of information concerning the position of the cut end 32 of the printing medium PM and the position of the mark 30 is received. Information to be input includes information concerning the distance between the position of the cut end 32 and the position of the mark 30. More specifically, the distance T actually measured by the user with a ruler or the like is directly input as a numerical value. For example, if the actual measurement value of the distance T is 31 mm, the input is "31". Alternatively, it is also possible to input information concerning the difference between the designed distance T2 between the printing unit 5 and the cutting unit 14 and the distance between the position of the cut end 32 and the position of the mark 30. For example, if the difference between the distance T actually measured by the user and the distance T2 is 1 mm, the input is "1".

In step S8, a correction value is calculated. If the input value in step S7 described above is 31 mm, since this value is larger than a logical value of 30 mm by 1 mm, the cutting position has shifted by 1 mm to the downstream side. When these values are substituted into the above equation, that is, D1=T3−T2, $$D1=31-30=1\text{ mm}$$

This value, 1 mm, is a correction value for the cutting position. The memory unit 26 stores the value as a cutting position correction value. When the user directly inputs the error, 1 mm, the memory unit 26 directly stores the value, 1 mm, as a cutting position correction value.

In step S9, the cutting position setting is updated. The designed distance C1 from the origin 8 to the cutting position 17 is updated to C2=C1+D1, as described in the example shown in FIG. 5B. In this case, C2=35 mm+1 mm=36 mm. The memory unit 26 stores the value after the update. C2=36 mm indicates that the distance from the origin 8 to the cutting position of the cutting unit 14 is 36 mm. In the subsequent conveyance control, the distance C2 after the update is used. With this operation, the cutting position of the printing medium PM in the normal printing operation is corrected.

In step S10, the processing corresponding to one unit is terminated. With that, the value of the corrected distance C2 is obtained, and the cutting position shift caused by a structural error without any conveyance error can be eliminated. Although in the correction control scheme described above, the value of C2 is stored, the correction value D1 may be stored, and the value of C2 may be computed when performing conveyance control.

Note that the position where the printing medium PM is cut in step S4 may be set based on the designed value of C1 or the current value of the distance C2. When displaying a width in a numerical value as user auxiliary information, as shown in FIG. 4B, a value set with reference to C1 or C2 is printed.

Second Embodiment

The first embodiment requires a measuring instrument such as a ruler to actually measure the distance T of the cut piece shown in FIG. 4B. The second embodiment will exemplify a case in which a pattern (to be referred to as a position acquisition pattern) which allows the acquisition of its position information without actually measuring the position of a mark 30 with respect to a cut end 32 is printed on a printing medium PM. When printing a position acquisition pattern, the conveyance of the printing medium PM is also stopped. This can eliminate any conveyance error concerning the measurement of the distance T.

Figure 7A:
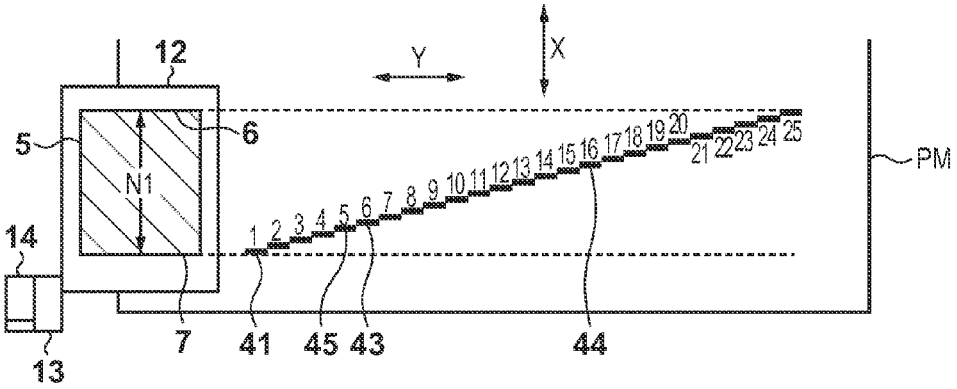
FIGS. 7A to 7C are views for explaining a method of measuring a cutting position shift when printing a pattern.

FIG. 7A shows an example of a position acquisition pattern. A control unit 20 can execute a pattern printing operation for the position acquisition pattern. The test operation described above is executed after a conveying unit 11 conveys the printing medium PM to a position where a cut end and a mark are located inside the print area of the position acquisition pattern in the X direction.

When printing the position acquisition pattern, first of all, the printing medium PM is conveyed to a position where printing is to be performed. The conveying operation is then stopped. In this state, ink is discharged from a printing unit 5 while a carriage 12 is moved. The nozzle to discharge ink is switched to another one in accordance with the position of the carriage 12. The position acquisition pattern is printed in this manner. Therefore, the position acquisition pattern has a width equal to or less than 1 inch (25 mm) which is a width N1 of the nozzle array. In addition, the position acquisition pattern will never include any conveyance error.

The position acquisition pattern is formed in a area longer than the distance between the carriage 12 and a cutting unit 14 in the X direction. This embodiment is based on the premise that the distance from a lowermost stream nozzle 7 to a cutting position 40 of the cutting unit 14 is equal to or less than the width N1 of the nozzle array. This makes it possible to cut the printing medium PM and print the mark within the position acquisition pattern.

In this embodiment, the position acquisition pattern has a staircase pattern extending in a direction oblique to the X direction, and is formed from a group of straight lines extending in the Y direction, each having a width of about 1 mm, arranged in steps of about 1 mm. For example, a straight line 41 at the most lower left position on the downstream side is drawn by using the 51 nozzles from the lowermost stream nozzle 7. A straight line with the maximum width can be divisionally printed by 1,280 nozzles. If a resolution of 0.1 mm is required for cutting position correction, 250 straight lines each having a width of about 0.1 mm may be printed in steps of about 0.1 mm. To print a straight line having a width of 0.1 mm, five nozzles may be used. The unit "about 0.1 mm" is set for the following reason. Since the width of each nozzle is fixed, it is possible to finely calculate to a decimal point in accordance with the width. In practice, using five nozzles will result in a value like 0.097 mm. For the sake of simplicity, this embodiment will be described based on a unit of 1 mm.

This embodiment uses a scheme of making the user designate a straight line, of the straight lines constituting the position acquisition pattern, which overlaps the cutting position. The embodiment therefore requires a mechanism of specifying each straight line. In the embodiment, serial numbers (1 to 25) are assigned to the respective straight lines, and printed on the upstream or downstream side of the straight lines. These serial numbers are printed while the conveyance of the printing medium PM is stopped. For this reason, serial numbers cannot be printed on the upstream side of straight lines on the uppermost stream side. For this reason, serial numbers are printed on the downstream side of the 20th to 25th straight lines.

The density of each straight line of the position acquisition pattern may be increased by performing scanning a plurality of times. In addition, adjacent straight lines may have different colors. Furthermore, the printing of serial numbers may include a conveyance error. It is therefore possible to print serial numbers while conveying the printing medium PM as in a normal printing operation after the printing of the position acquisition pattern. In this case, all the serial numbers can be printed on the upstream side of the corresponding straight lines. In addition, symbols indicating the respective straight lines are not limited to serial numbers, and other symbols can be printed as long as they allow the respective straight lines to be discriminated.

Figure 7B:
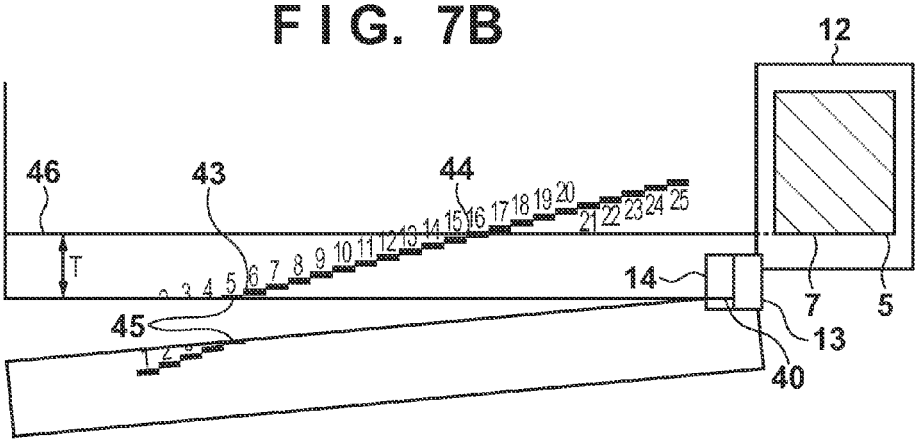

FIG. 7B shows a state in which a mark 46 is printed and the printing medium PM is cut while the conveyance of the printing medium PM is stopped as in the case shown in FIG. 4A. A difference from the state shown in FIG. 4A is that the printing medium PM is conveyed such that a cutting position 40 and the position of the mark 46 fall within the position acquisition pattern after it is printed.

In this example, the mark 46 is printed by the lowermost stream nozzle 7. As shown in FIG. 5A, without any structural error, a designed value T1 of the distance between a cutting position 17 of the cutting unit 14 and the lowermost stream nozzle 7 is 10 mm. In the case shown in FIG. 7B, the mark 46 overlaps a straight line 44 corresponding to serial number 16. Without any structural error, the cutting position 40 should overlap a straight line 43 corresponding to serial number 6. However, the cutting position 40 overlaps a straight line 45 corresponding to serial number 5. Therefore, a shift of 1 mm has occurred on the downstream side.

Processing Example

Figure 8:
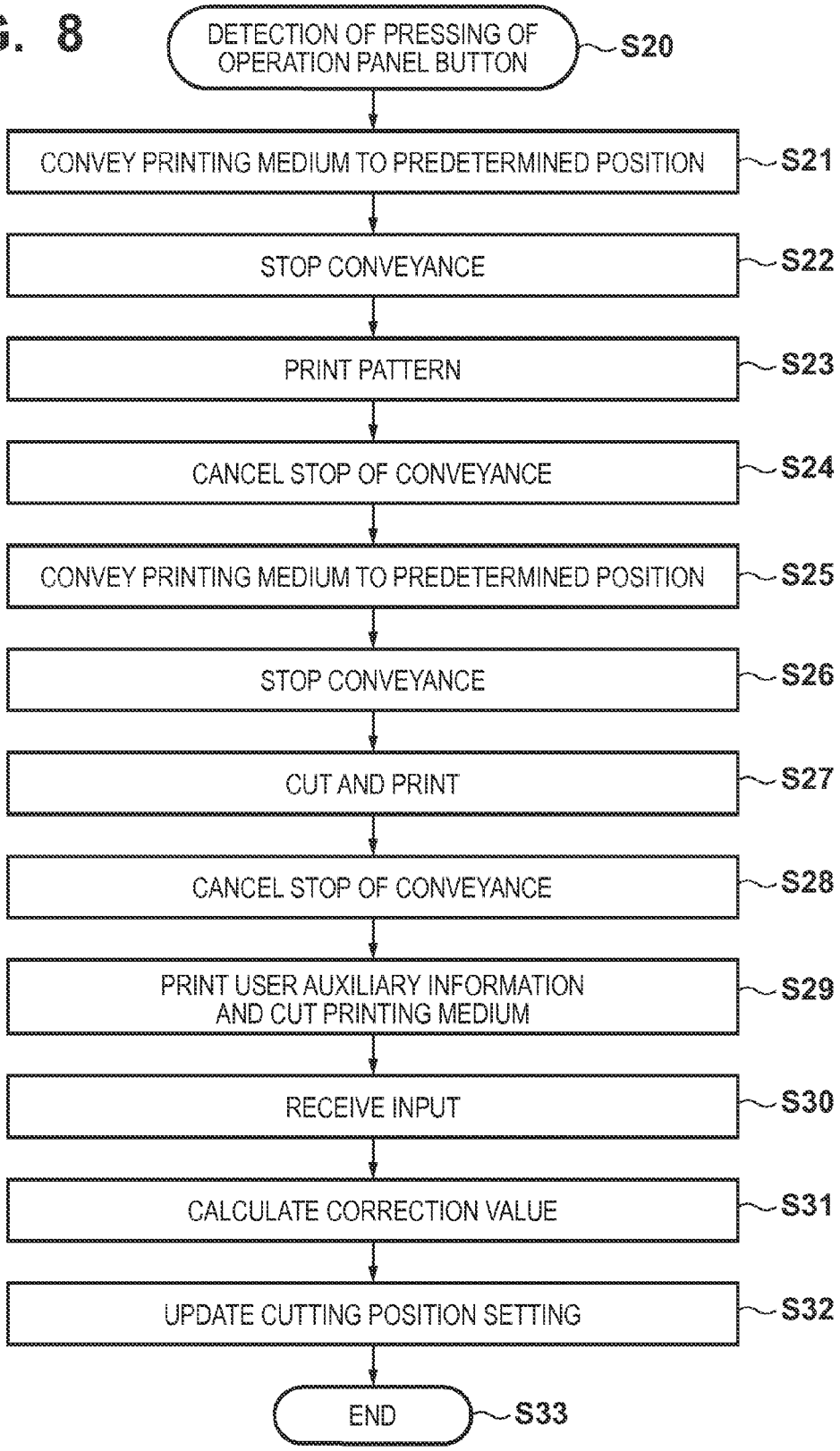
FIG. 8 is a flowchart showing an example of the processing executed by the control unit in FIG. 2.

An example of the processing performed by the control unit 20 concerning a test operation and correction value setting associated with a cutting position shift in this embodiment will be described with reference to FIG. 8. The main difference from the example shown in FIG. 6 in the first embodiment is that a position acquisition pattern printing operation in steps S20 to S24 is added between steps S1 and S2 in FIG. 6.

Upon detection in step S21 that a key indicating the start of execution on an operation panel 22 is pressed, cutting position correction processing is started. In step S21, the conveying unit 11 conveys the printing medium PM to a position where a position acquisition pattern is printed. FIG. 7A shows the position of the printing medium PM.

In step S22, the conveying operation of the conveying unit 11 is stopped. In step S23, the position acquisition pattern is printed on the printing medium PM by only moving the carriage 12 without conveying the printing medium PM. FIG. 7A shows a state of completion of printing of the position acquisition pattern, that is, the straight lines in the staircase pattern and the serial numbers corresponding to the respective straight lines. Since the printing medium PM is not conveyed, the position acquisition pattern includes no conveyance error.

In step S24, the stop of the conveyance of the printing medium PM is canceled to enable conveyance. In step S25, the printing medium PM is conveyed to the position in FIG. 7B to print the mark 46 and cut the printing medium PM. A conveyance amount is set to locate the mark 46 approximately at the position of the straight line 44.

Figure 6:
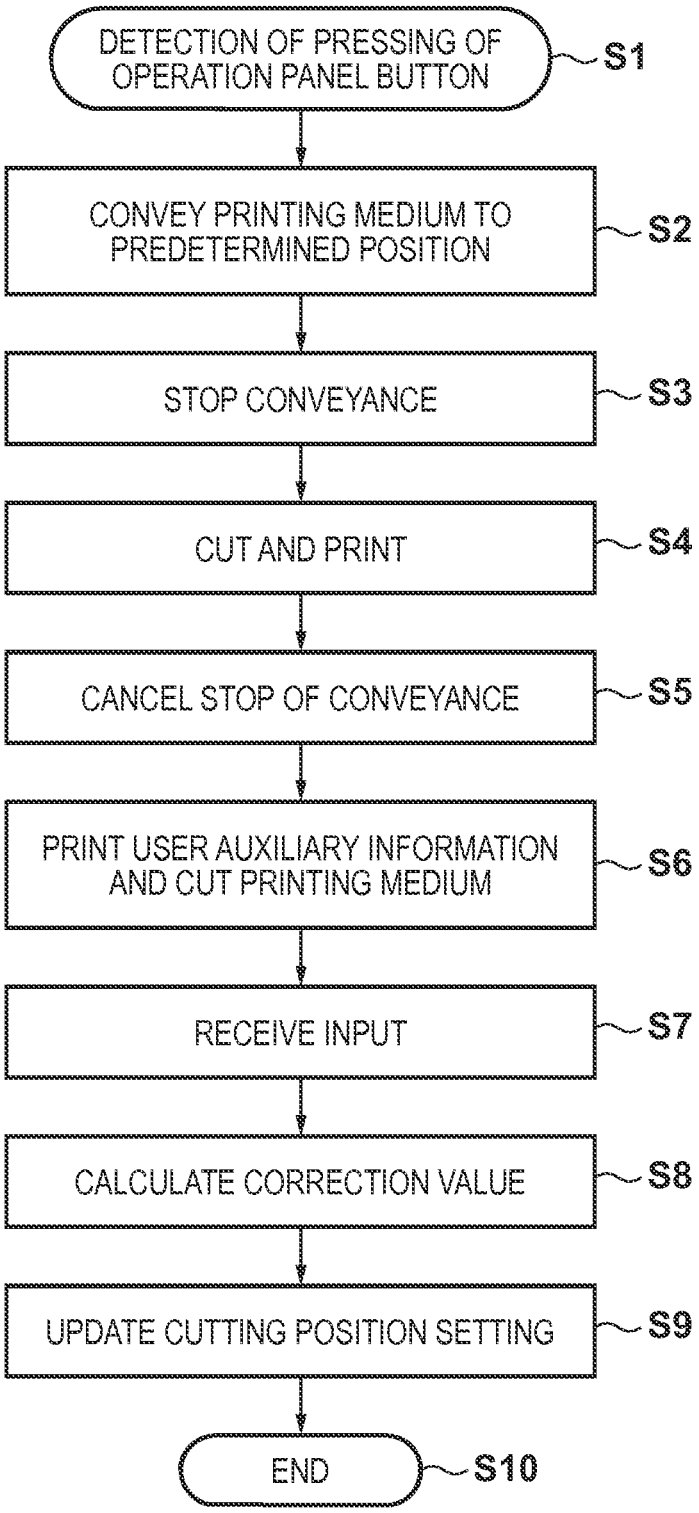
FIG. 6 is a flowchart showing an example of the processing executed by the control unit in FIG. 2.

The processing in steps S25 to S33 is the same as that in steps S3 to S10 in FIG. 6. In step S26, the conveyance of the printing medium is stopped, and the conveying operation of the printing medium PM is not performed until the processing in step S27 is complete. In step S27, the printing medium PM is cut by the cutting unit 14, and the mark 46 is printed. In step S28, the stop of the conveyance of the printing medium PM is canceled to enable conveyance. In step S29, user auxiliary information is printed on the printing medium PM. Thereafter, the printing medium PM is conveyed and cut.

In step S30, the input of information concerning the position of the cut end of the printing medium PM and the position of the mark 46 is received. The user inputs the serial numbers of straight lines, of the position acquisition pattern, which respectively overlap the cutting position 40 and the mark 46 by using the operation panel. In the case shown in FIG. 7B, the serial number of the straight line overlapping the cutting position 40 is 5, and the serial number of the straight line overlapping the mark 46 is 16. Therefore, the user inputs these numerical values.

In step S31, a correction value is calculated. The distance T from the cut end to the mark 46 can be calculated as 11 mm from the input result in step S30. The distance T1 is 10 mm, and T1=T2 in this embodiment. Therefore, the error D1 is given by $$D1=11-10=1\text{ mm}$$

This value, 1 mm, is a correction value for the cutting position. The memory unit 26 stores the value as a cutting position correction value.

In step S32, the cutting position setting is updated. Since C2=C1+D1, C2=35 mm+1 mm=36 mm. The memory unit 26 stores the value, 36 mm, after the update, and the processing is terminated (step S33).

Figure 7C:
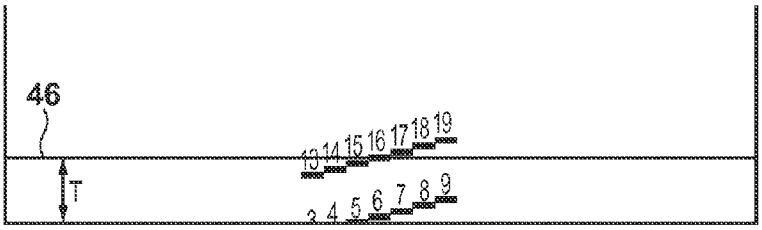

As described above, in this embodiment, printing the position acquisition pattern can save the user from performing measurement. In some cases, as the number of straight lines of the position acquisition pattern increases, the position acquisition pattern cannot fall within the width (in the Y direction) of the printing medium PM. In such a case, the position acquisition pattern may be printed before and after the designed cutting position and before and after the designed mark. FIG. 7C shows an example of such a mark.

In this case, the position acquisition pattern is constituted by three straight lines before and after the sixth straight line from the lower left end, which is the designed cutting position, and three straight lines before and after the 16th straight line from the lower left end, which is the designed printing position of the mark 46. The position acquisition pattern is printed in two rows in the middle of the width (in the Y direction) of the printing medium PM instead of being printed in on row. It is possible to form various forms of position acquisition patterns within the range in which the printing medium PM is not conveyed.

Third Embodiment

In the first and second embodiments, the user inputs information concerning the position of the cut end of the printing medium PM and the position of a mark. It is however possible to detect the positions of the cut end and the mark by using a detecting unit 13. FIGS. 9A to 9D are views for explaining this operation.

Figure 9A:
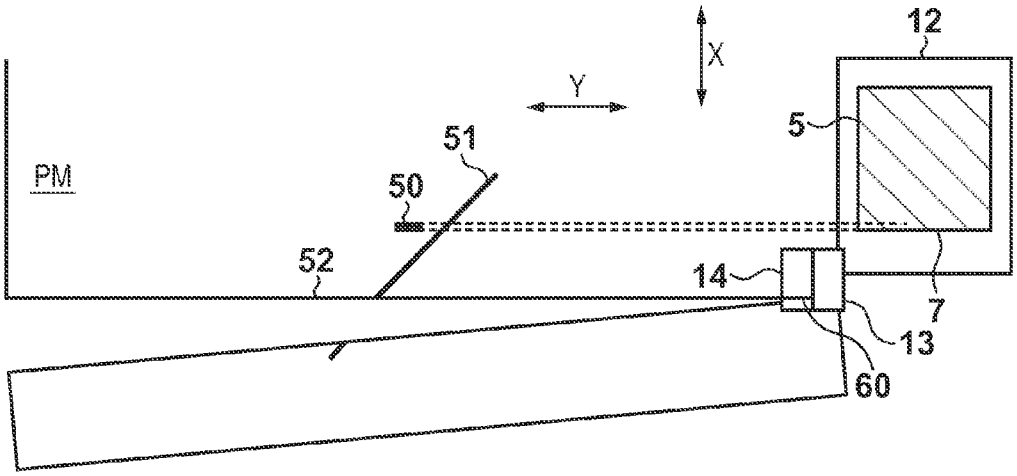
FIGS. 9A to 9D are views for explaining a method of automatically measuring a cutting position shift.

FIG. 9A shows a state in which a mark 50 and a position acquisition pattern 51 are printed, and the printing medium PM is cut at a cutting position 60. In this embodiment, the user need not identify the position acquisition pattern 51, and hence there is little necessity to consider user viewability. For this reason, in this case, the pattern is printed in a linear pattern extending in a direction oblique to the X direction. The mark 50 is also only required to be detected by the detecting unit 13, and hence is printed as a short straight line. In this case, a line having a thickness of 1 mm is printed in a length of 20 mm, as an example, upstream from a lowermost stream nozzle 7. The thickness of this line is set to 1 mm in consideration of reducing false detection by discriminating the line from a stain or the like on the printing medium PM. The position of the mark 50 in the X direction is set with reference to the edge on the upstream side, and the position of the corresponding nozzle corresponds to a nozzle located 1 mm upstream from the lowermost stream nozzle 7.

Methods of printing the position acquisition pattern 51 and the mark 50 and cutting the printing medium PM at the cutting position 60 are the same as those in the second embodiment.

A method of detecting the distance between a cut end 52 and the mark 50 will be described below. There is conceivable a method of conveying the printing medium PM until the mark 50 is detected after a cutting unit 14 detects the cut end 52 and regarding the conveyance amount as the distance between the cut end 52 and mark 50. This method, however, directly includes a conveyance error.

In general, a position detection error concerning a carriage 12 is smaller in variation than a conveyance error. For example, in a scheme of reading the scale provided on the main body of a printing apparatus 1 by using a sensor (encoder) mounted on the carriage 12, a position detection error is extremely smaller than a conveyance error. This embodiment, therefore, mainly uses the movement of the carriage 12 and the position acquisition pattern 51.

Figure 9B:
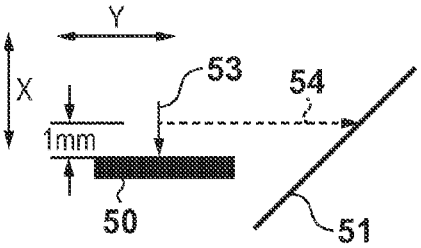

FIG. 9B is an enlarged view of a portion around the mark 50 detected by the detecting unit 13. Assume that a portion on the printing medium PM which the light emitted from the light-emitting element in the detecting unit 13 strikes is a sensor spot. The printing medium PM is conveyed downstream so as to locate the sensor spot on the upstream side of the mark 50 upon completion of printing of the mark 50 and cutting at the cutting position 60. In addition, the carriage 12 is moved so as to locate the sensor spot in the middle of the mark 50 in the Y direction.

As a result, the sensor spot is located at the position of the start point of an arrow 53 indicating the reading direction of the detecting unit 13. Subsequently, the position of the mark 50 in the X direction is detected while the printing medium PM is conveyed in the upstream direction. The sensor spot moves on the printing medium PM as indicated by the arrow 53. It is possible to detect the position of the mark 50 in the X direction by referring to a conveyance amount when the light received by the light-receiving element in the detecting unit 13 decreases below a threshold at this time. This is because reflected light decreases when the sensor spot crosses the black portion as the mark 50.

As described above, the position of the mark 50 is set with reference to an edge on the upstream side, and corresponds to the 51st nozzle position as a position located 1 mm upstream from the lowermost stream nozzle 7. The following description is based on the assumption that the position of the mark 50 coincides with the 51th nozzle located upstream from the lowermost stream nozzle 7, which corresponds to the position of the edge of the mark 50 on the upstream side. Upon detection of the position of the mark 50, the printing medium PM is conveyed downstream so as to locate the spot sensor at a position 1 mm downstream from the position where the mark 50 is printed. In this state, the sensor spot is located at the position of the start point indicated by a broken line 54.

Subsequently, the carriage 12 is moved such that the sensor spot operates in the Y direction, and the position of the position acquisition pattern 51 (the position of the intersection point between the pattern 51 and the broken line 54) is detected. As described above, position detection depends on the position of the carriage 12 at the time point of change of the light reception result obtained by the light-receiving element.

Figure 9C:
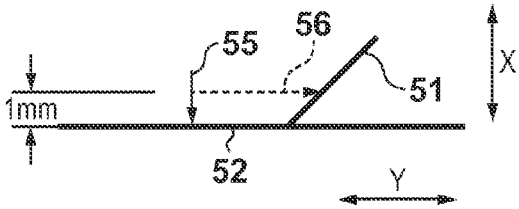

FIG. 9C is an enlarged view of a portion where the detecting unit 13 reads the position of the cut end 52. The position of the cut end 52 can be predicted to some extent. The carriage 12 is moved in advance to a position located slightly left of the position where the leading end near the position acquisition pattern 51 is read in FIG. 9C.

The sensor spot is located at a position on the printing medium PM which is the start point of an arrow 55 in FIG. 7C. The printing medium PM is then conveyed upstream from this position, and the detecting unit 13 detects the position of the cut end 52. As indicated by the arrow 55, the position of the sensor spot moves on the printing medium PM. As described above, position detection depends on a conveyance amount at the time point of charge of the light reception result obtained by the light-receiving element.

Upon detection of the position of the cut end 52, the printing medium PM is conveyed downstream so as to locate the spot of the sensor 13 at a position located 1 mm downstream from the detected position. In this state, the sensor spot is located at the start point of a broken line 56. Subsequently, the carriage 12 is moved such that the sensor spot operates in the Y direction, and the position of the position acquisition pattern 51 (the position of the intersection point between the pattern 51 and the broken line 56) is detected. As described above, position detection depends on the position of the carriage 12 at the time point of change of the light reception result obtained by the light-receiving element.

Figure 9D:
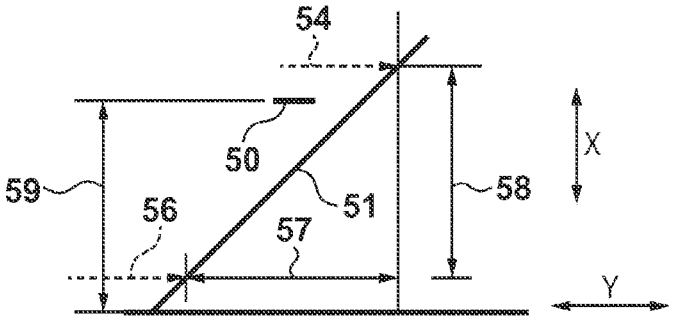

FIG. 9D is a view showing how the distance from the cut end 52 to the mark 50 is obtained. It is possible to obtain a distance 57, in the Y direction, from the position detected in the manner shown in FIGS. 9B and 9C to a position located 1 mm upstream from the cut end 52 and a position located 1 mm upstream from the mark 50 (that is, the position of the head located 1 mm upstream from the lowermost stream nozzle).

Assuming that the angle of the position acquisition pattern 51 with respect to the X direction is 45°, the distance 57 in the Y direction is equal to a distance 58 in the X direction. The distance 58 is located 1 mm upstream from a distance 59, and equal to it.

The distance 57 is therefore equal to the distance 59 from the cut end 52 to the mark 50. T1 shown in FIG. 5A is 10 mm, and a position located 1 mm upstream T1 is detected. Therefore, T2=11 mm. The difference between T2 and the distance 57 is the error D1, which is 1 mm. This value is stored as a correction value for the cutting position.

As described above, in this embodiment, a distance in the Y direction is converted into a distance in X direction by using the position acquisition pattern 51. When, for example, an encoder which detects the position of the carriage 12 differs in resolution from an encoder which detects the rotation amount of conveying rollers 11*a*, changing the angle of the position acquisition pattern 51 can easily improve the resolution. That is, when setting the angle to 45°, the ratio of the corresponding distance in the carriage direction to that in the conveying direction becomes 1:1, that is, the distances become equal to each other, whereas when setting the angle to 60°, the ratio becomes 1:2, that is, the resolution can be doubled.

In this embodiment, as shown in FIGS. 9B and 9C, when measuring a distance in the Y direction, the sensor spot is moved by 1 mm upstream from the position of a measurement target. This conveyance of 1 mm can include a conveyance error. Note however that since the conveyance amounts are the same in both the cases, the same amount of error occurs without any variation factor, and errors cancel each other, if any. Variation factors include a change in the type of printing medium PM, a weight, and aged deterioration, which are regarded as a series of operations, and hence do not include any factors that cause great changes. In addition, great environmental changes are rare in a series of short times. For this reason, it can be said that in most cases, even if conveyance errors occur, the amounts of errors are the same. That is, the distances 59 and 58 should be equal to each other. Even if conveyance errors occur, the same applies when the errors are the same. Even if different conveyance errors have occurred, since the respective conveyance amounts are set to 1 mm, the conveyance errors remain in minute feeding operations. That is, the errors can be neglected.

When verifying a cutting position shift, therefore, it is still possible to reduce the influence of an error in the conveyance amount of a printing medium. Note that it is possible to detect the position acquisition pattern 51 without performing conveyance of 1 mm depending on the arrangement of the sensor of the detecting unit 13, for example, a sensor spot diameter. In this case, it is possible to eliminate the influence of a conveyance error. For example, a plurality of sensors are provided in the detecting unit 13. One of the sensors detects the cut end 52, and another sensor located upstream from the cut end 52 detects the position acquisition pattern 51.

In addition, it is possible to reduce the influence of a conveyance error by setting the conveyance amount to a value smaller than 1 mm. As described above, although the conveyance amount is set to 1 mm upstream from the detection position of the pattern 51 in the conveying direction, the conveyance amount may be another value.

Fourth Embodiment

The position acquisition pattern described in the second and third embodiments needs to be printed in an area longer than the distance between the printing unit 5 and the cutting unit 14 in the X direction. If the distance between the printing unit 5 and the cutting unit 14 exceeds a width N1 of the nozzle array, a printing medium PM needs to be conveyed. That is, the position acquisition pattern needs to be divisionally printed in a plurality of processes, and the printing medium PM needs to be conveyed in each process. In this case, a conveyance error raises a problem. For this reason, the printing medium PM is conveyed such that print areas of patterns in the respective processes overlap each other in the X direction to discriminate a conveyance error.

Figure 10A:
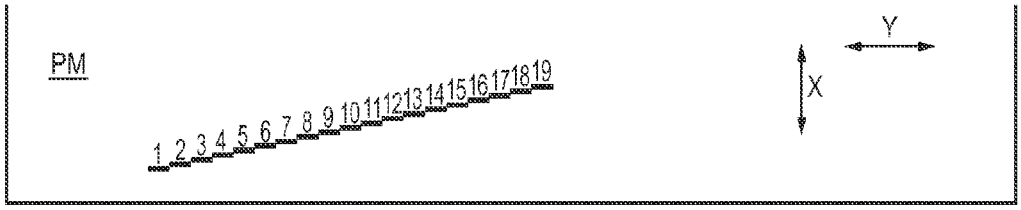
FIGS. 10A to 10C are views for explaining an example of printing a pattern.
Figure 10B:
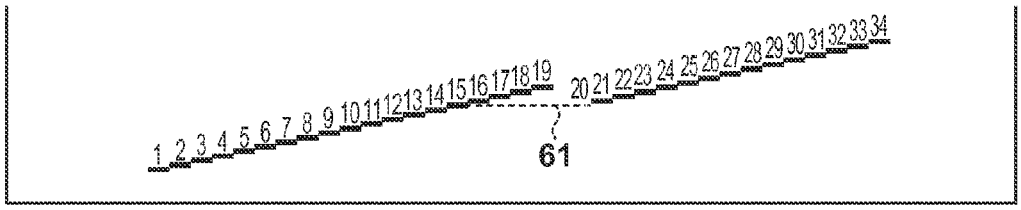
Figure 10C:
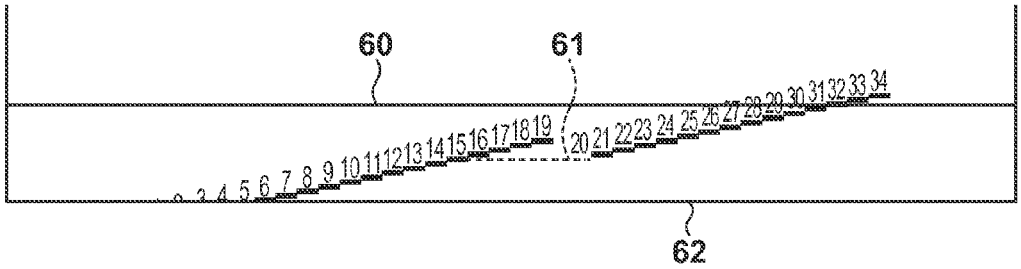

FIGS. 10A to 10C are views each showing an example of how a position acquisition pattern is printed in this embodiment. In this case, as in the second embodiment, it is assumed that the position acquisition pattern is formed in a staircase pattern. However, as in the third embodiment, the position acquisition pattern may be linear. In addition, the pattern may be measured by the user or automatically measured by a detecting unit 13.

FIG. 10A shows a state in which the first pattern as part of the position acquisition pattern is formed. The first pattern is constituted by straight lines assigned with serial numbers 1 to 19. The first pattern is printed by only moving the carriage 12 without conveying the printing medium PM.

The printing medium PM is then conveyed by a predetermined amount to form the second pattern as the remaining part of the position acquisition pattern, as shown in FIG. 10B. The second pattern is constituted by straight lines assigned with serial numbers 20 to 34. Only a straight line 61 assigned with serial number 20 is shown in a broken line, and is elongated in the Y direction. The second pattern is also printed by only moving the carriage 12 without conveying the printing medium PM.

As shown in FIG. 10B, part of the second pattern on the downstream side overlaps part of the first pattern on the upstream side in the X direction. This operation is implemented by setting the conveyance amount by which the printing medium PM is conveyed to a position where the second pattern is formed after the formation of the first patter such that the print area of the first pattern overlaps the print area of the second pattern in the X direction.

This makes it possible to discriminate a conveyance error. Assume that when there is no conveyance error, the position of the straight line 61 of the second pattern which is assigned with serial number 20 coincides with the position of the straight line of the first pattern which is assigned with serial number 16 in the X direction. In the case shown in FIG. 10B, as indicated by the straight line 61, the position of the straight line of the second pattern which is assigned with serial number 20 coincides with the position of the straight line assigned with serial number 15 instead of the straight line of the first pattern which is assigned with serial number 16. That is, it is known that there is a conveyance error corresponding to one step (1 mm). When the user inputs information concerning this error, the control unit 20 can compute the conveyance error.

In this embodiment, only the straight line 61 is printed as a different straight line to improve visibility. As described above, the second pattern may include a portion differing in at least shape or color from the first pattern. Using a different portion overlapping another pattern in the X direction, in particular, produces a beneficial effect. As indicated by the straight line 61, a straight line may be changed in width instead of being extended or changed from a solid line to a broken line. Alternatively, the straight line may be printed in red or the like.

FIG. 10C shows a state in which a mark 60 is printed, and the printing medium PM is cut. Upon completion of printing of a position acquisition pattern, the printing medium PM is conveyed such that a cut end 62 and the mark 60 are located within the print area, as shown in FIG. 10C. For example, the mark 60 is printed by a lowermost stream nozzle 7 at the shortest distance between the cutting position and the nozzle position so as to minimize the number of straight lines of the position acquisition pattern. If there is no need to consider the number of straight lines of the position acquisition pattern, a nozzle at any position can be used.

The cutting position overlaps the straight line assigned with serial number 5, and the mark 60 overlaps the straight line assigned with serial number 32. The user inputs a total of three pieces of information including two pieces of information concerning these two positions and information concerning a conveyance error by using an operation panel 22. The information concerning the conveyance error is designated by the serial number (15) of the straight line of the first pattern which overlaps the straight line 61 assigned with serial number 20. Therefore, for example, the user inputs the three pieces of information in the form of (5, 32, 15) or the like.

Upon acquiring the three values, the control unit 20 computes a distance T from the cut end 62 to the mark 60. If there is no conveyance error, the first pattern overlaps the second pattern by four straight lines. In this case, the conveyance error corresponds to one straight line. Therefore, distance T=32−5−5=22 mm. Comparing the distance T with the designed value can obtain a correction value D1 originating from only a structural error without any conveyance error. Referring to FIGS. 10A to 10C, the position acquisition pattern divisionally printed in two processes. Based on the same technical idea, the position acquisition pattern may be divisionally printed in three or more steps.

Processing Example

Figure 11:
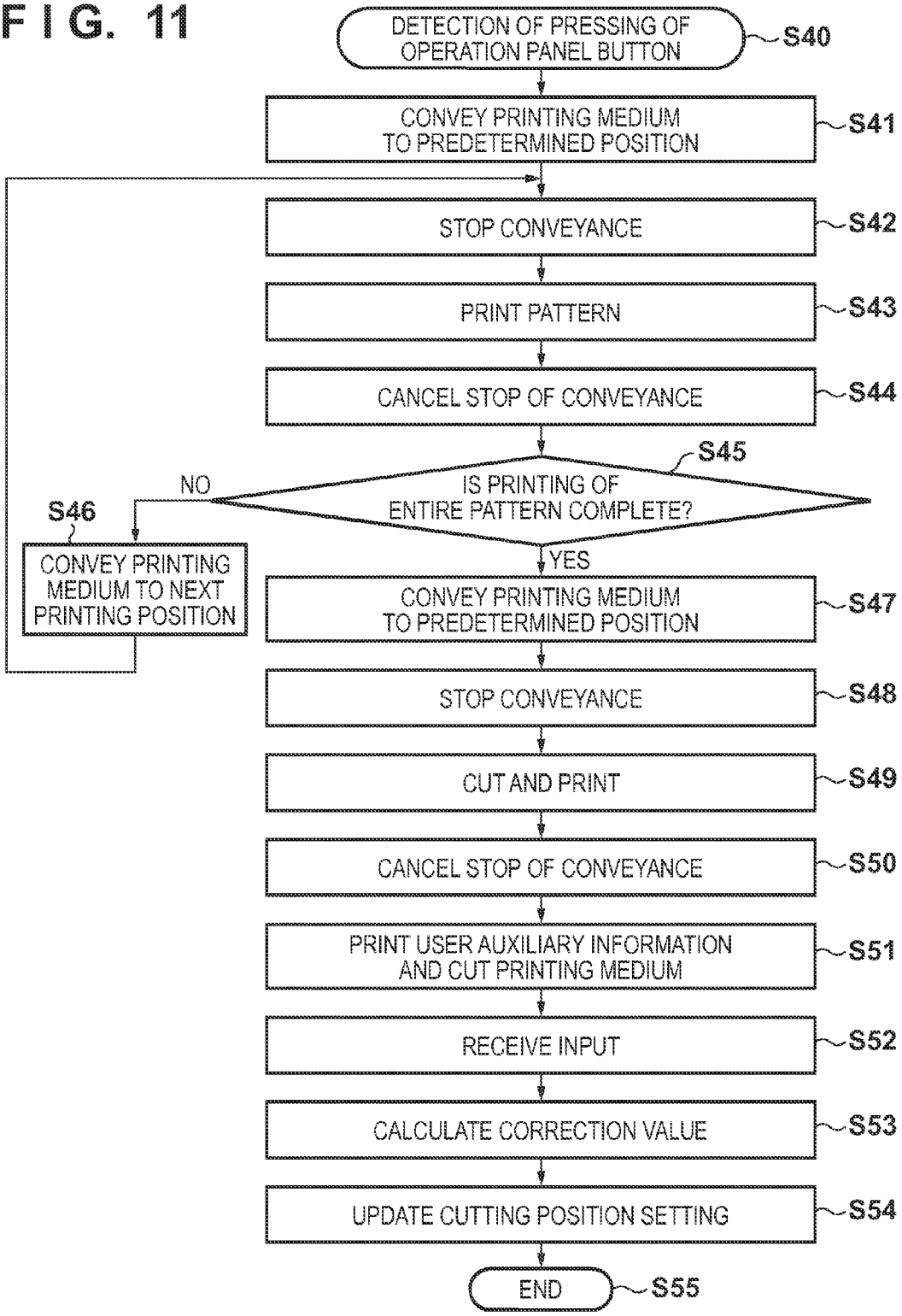
FIG. 11 is a flowchart showing an example of the processing executed by the control unit FIG. 2.

An example of the processing performed by the control unit 20 concerning a test operation and correction value setting associated with a cutting position shift in this embodiment will be described with reference to FIG. 11. The main difference from the example shown in FIG. 8 in the second embodiment is in the printing of a position acquisition pattern in steps S22 to S24 in FIG. 8. In this embodiment, since a cutting position and a mark position do not fall within a position acquisition pattern by one printing operation, printing is performed a plurality of times while pattern portions overlap each other. For this reason, the processing from step S42 to step S46 is performed instead of the processing from step S22 to step S24.

Upon detection in step S40 that a key indicating the start of execution on the operation panel 22 is pressed, cutting position correction processing is started. In step S41, the conveying unit 11 conveys the printing medium PM to a position where the first pattern of the position acquisition pattern is printed. FIG. 10A shows the position of the printing medium PM. In step S42, the conveying operation of the conveying unit 11 is stopped. In step S43, the first pattern is printed by only moving the carriage 12 without conveying the printing medium PM. FIG. 10A shows a state of completion of printing of the first pattern, that is, the straight lines in the staircase pattern and the serial numbers corresponding to the respective straight lines. Since the printing medium PM is not conveyed, the position acquisition pattern includes no conveyance error.

In step S44, the stop of the conveyance of the printing medium PM is canceled to enable conveyance. In step S45, it is determined whether all the patterns constituted the position acquisition pattern are printed. If YES in step S45, the process to step S47. If NO in step S45, the process advances to step S46.

In step S46, the conveying unit 11 conveys the printing medium PM to a position where the next pattern is printed. FIG. 10B shows the position of the printing medium PM at which the second pattern is to be printed, immediately after the printing of the first pattern.

When the entire position acquisition pattern is printed, the printing medium PM is conveyed in step S47 to the position in FIG. 10C to print the mark 60 and cut the printing medium PM. The subsequent processing is the same as that in step S26 and the subsequent steps in FIG. 8, and hence a description of the processing will be omitted.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blue-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2013-259504, filed Dec. 16, 2013, which is hereby incorporated by reference herein in its entirety.

What is claimed is:

1. A printing apparatus comprising:

a conveying unit configured to convey a printing medium;

a printing unit configured to print an image on the printing medium;

a cutting unit configured to cut the printing medium in a direction perpendicular to a conveying direction of the printing medium; and a control unit configured to control said conveying unit, said printing unit, and said cutting unit, wherein said control unit is configured to execute a test operation, conveyance of the printing medium by said conveying unit is stopped during the test operation, and the test operation includes printing a mark on the printing medium by using said printing unit and cutting the printing medium by using said cutting unit.

2. The apparatus according to claim 1, wherein the mark comprises a straight line extending in a direction perpendicular to the conveying direction of the printing medium.

3. The apparatus according to claim 1, wherein the control unit is configured to execute a pattern printing operation of printing a pattern on the printing medium by using said printing unit while conveyance of the printing medium by said conveying unit is stopped, the pattern is formed in an area longer than a distance between said printing unit and said cutting unit in a conveying direction of the printing medium, and the test operation is executed after said conveying unit conveys the printing medium such that the cut end and the mark are located within a print area of the pattern in the conveying direction of the printing medium.

4. The apparatus according to claim 3, further comprising a carriage having said printing unit mounted thereon and configured to move in a direction perpendicular to the conveying direction of the printing medium, wherein said printing unit includes a plurality of nozzles arrayed in the conveying direction of the printing medium, and the pattern is printed by switching a nozzle to discharge ink in accordance with a position of said carriage.

5. The apparatus according to claim 4, wherein the pattern has one of a linear pattern or a staircase pattern extending in a direction oblique to the conveying direction of the printing medium.

6. The apparatus according to claim 1, wherein control unit is configured to execute a pattern printing operation of printing a pattern on the printing medium by using said printing unit, the pattern includes a first pattern printed while conveyance of the printing medium by said conveying unit is stopped, and a second pattern printed after formation of the first pattern while the printing medium is conveyed by a predetermined amount and stopped, the predetermined amount is set such that a print area of the first pattern overlaps a print area of the second pattern in the conveying direction of the printing medium, the pattern is formed in an area longer than a distance between said printing unit and said cutting unit in the conveying direction of the printing medium, and the test operation is executed after said conveying unit conveys the printing medium such that the cut end and the mark are located within a print area of the pattern in the conveying direction of the printing medium.

7. The apparatus according to claim 6, wherein the second pattern includes a portion differing in at least one of shape or color from the first pattern.

8. The apparatus according to claim 6, further comprising a carriage having said printing unit mounted thereon and configured to move in a direction perpendicular to the conveying direction of the printing medium, wherein said printing unit includes a plurality of nozzles arrayed in the conveying direction of the printing medium, and the pattern is printed by switching a nozzle to discharge ink in accordance with a position of said carriage.

9. The apparatus according to claim 8, wherein the pattern has one of a linear pattern or a staircase pattern extending in a direction oblique to the conveying direction of the printing medium.

10. The apparatus according to claim 1, wherein in the test operation, one of printing of the mark or cutting the printing medium is performed first.

11. The apparatus according to claim 1, wherein in the test operation, printing of the mark and cutting of the printing medium are simultaneous performed.

12. A printing apparatus comprising:

a conveying unit configured to convey a printing medium;

a printing unit configured to print an image on the printing medium;

a cutting unit configured to cut the printing medium in a direction perpendicular to a conveying direction of the printing medium; and a control unit configured to control said conveying unit, said printing unit, and said cutting unit, wherein said control unit is configured to execute a test operation, the test operation includes printing a mark by using said printing unit and cutting the printing medium by using said cutting unit while conveyance of the printing medium by said conveying unit is stopped, said control unit is configured to execute a printing operation including conveying the printing medium by using said conveying unit, printing an image on the printing medium by using said printing unit, and cutting the printing medium by using said cutting unit, and a cutting position of the printing medium in the printing operation is corrected based on information concerning a position of a cut end of the printing medium and a position of the mark in the test operation.

13. The apparatus according to claim 12, wherein said control unit receives input of the information by the user.

14. The apparatus according to claim 12, further comprising a detecting unit configured to detect the position of the cut end and the position of the mark, wherein said control unit corrects the cutting position of the printing medium in the printing operation based on a detection result obtained by said detecting unit as the information.

15. The apparatus according to claim 12, wherein the information comprises one of information concerning a distance between the position of the cut end and the position of the mark and information concerning a difference between a designed distance between said printing unit and said cutting unit and a distance between the position of the cut end and the position of the mark.

16. A method of controlling a printing apparatus including a conveying unit configured to convey a printing medium, a printing unit configured to print an image on the printing medium, and a cutting unit configured to cut the printing medium in a direction perpendicular to a conveying direction of the printing medium, the method comprising:

conveying the printing medium by using the conveying unit; and executing a test operation, wherein conveyance of the printing medium by the conveying unit is stopped during the test operation, and the test operation includes printing a mark by using the printing unit and cutting the printing medium by using the cutting unit.

17. The method according to claim 16, further comprising executing a printing operation including conveying the printing medium by using said conveying unit, printing an image on the printing medium by using said printing unit, and cutting the printing medium by using said cutting unit, wherein a cutting position of the printing medium in the printing operation is corrected based on information concerning a position of a cut end of the printing medium and a position of the mark in the test operation.

18. A non-transitory storage medium storing a program for causing a printing apparatus including a conveying unit configured to convey a printing medium, a printing unit configured to print an image on the printing medium, and a cutting unit configured to cut the printing medium in a direction perpendicular to a conveying direction of the printing medium to execute conveying the printing medium by using the conveying unit, and executing a test operation, wherein conveyance of the printing medium by the conveying unit is stopped during the test operation, and the test operation includes printing a mark by using the printing unit and cutting the printing medium by using the cutting unit.

19. The method according to claim 18, further comprising executing a printing operation including conveying the printing medium by using said conveying unit, printing an image on the printing medium by using said printing unit, and cutting the printing medium by using said cutting unit, wherein a cutting position of the printing medium in the printing operation is corrected based on information concerning a position of a cut end of the printing medium and a position of the mark in the test operation.

* * * * *